US005266937A

United States Patent [19]

DiSanto et al.

[11] Patent Number: 5,266,937

[45] Date of Patent: Nov. 30, 1993

[54] METHOD FOR WRITING DATA TO AN ELECTROPHORETIC DISPLAY PANEL

[75] Inventors: Frank J. DiSanto, North Hills; Denis A. Krusos, Lloyd Harbor; Edward Lewit, Roslyn Heights, all of N.Y.

[73] Assignee: CopyTele, Inc., Huntington Station, N.Y.

[21] Appl. No.: 796,759

[22] Filed: Nov. 25, 1991

[51] Int. Cl.[5] ..... G09G 3/34

[52] U.S. Cl. ..... 345/107; 345/84

[58] Field of Search ..... 340/787, 788, 805, 783, 340/785, 786, 811, 814; 359/296; 358/241, 236

[56] References Cited

U.S. PATENT DOCUMENTS

| | | | |
|---|---|---|---|
| 4,630,122 | 12/1986 | Morokawa | 358/241 |
| 4,655,897 | 4/1987 | DiSanto et al. | 359/296 |
| 4,732,830 | 3/1988 | DiSanto et al. | 359/54 |
| 4,742,345 | 5/1988 | DiSanto et al. | 340/787 |
| 4,833,464 | 5/1989 | DiSanto et al. | 340/787 |
| 4,901,066 | 2/1990 | Kobayashi et al. | 340/783 |

*Primary Examiner*—Tommy Chin
*Assistant Examiner*—A. Ay
*Attorney, Agent, or Firm*—Arthur L. Plevy

[57] ABSTRACT

A method for writing data to an EPID display includes loading data for a line of pixels onto the grid lines of the EPID. Instead of writing that single line fully by enabling the associated cathode row with a logical "1" voltage for the time necessary to cause complete pigment particle migration, the associated cathode line and at least the next adjacent cathode line are enabled for a shorter duration than is required for fully writing the lines. The grid is then loaded with data corresponding to the next line of pixels and the set of cathode lines enabled is shifted by one line, such that at least one cathode line previously enabled is enabled for a subsequent time whereby particle migration for writing is made more complete where the grid data is constant from one row of pixels to the next.

26 Claims, 4 Drawing Sheets

METHOD FOR WRITING DATA TO AN ELECTROPHORETIC DISPLAY PANEL

TECHNICAL FIELD

The present invention relates to a method for operating an electrophoretic display panel apparatus and, more particularly, to a method which increases the speed with which information can be written to an electrophoretic display panel.

BACKGROUND ART

Electrophoretic displays (EPIDS) are now well known. A variety of display types and features are taught in several patents issued in the names of Frank J. DiSanto and Denis A. Krusos and assigned to the assignee herein, Copytele, Inc. of Huntington Station, N.Y. For example, U.S Pat. Nos. 4,655,897 and 4,732,830, each entitled ELECTROPHORETIC DISPLAY PANELS AND ASSOCIATED METHODS describe the basic operation and construction of an electrophoretic display. U.S. Pat. No. 4,742,345, entitled ELECTROPHORETIC DISPLAY PANELS AND METHODS THEREFOR, describes a display having improved alignment and contrast. U.S. Pat. No. 4,833,464 entitled ELECTROPHORETIC INFORMATION DISPLAY (EPID) APPARATUS EMPLOYING GREY SCALE CAPABILITY relates to an EPID with the capability to display pixels of varying grey scale intensity. This patent recognizes, inter alia, that the duration of application of a voltage gradient at a particular pixel location effects the quantity of pigment particles at that location. Hence, by controlling the time duration of the write pulse one can achieve grey scale capability—the shorter the pulse, the lighter the line.

The display panels shown in the above-mentioned patents operate upon the same basic principle, viz., if a suspension of electrically charged pigment particles in a dielectric fluid is subjected to an applied electrostatic field, the pigment particles will migrate through the fluid in response to the electrostatic field. Given a substantially homogeneous suspension of particles having a pigment color different from that of the dielectric fluid, if the applied electrostatic field is localized, it will cause a visually observable localized pigment particle migration. The localized pigment particle migration results either in a localized area of concentration or rarefaction of particles depending upon the sign and direction of the electrostatic field and the charge on the pigment particles. The electrophoretic display apparatus taught in the foregoing U.S. patents are "triode-type" displays having a plurality of independent, parallel, cathode row conductor elements or "lines" deposited in the horizontal on one surface of a glass viewing screen. A layer of insulating photoresist material deposited over the cathode elements and photoetched down to the cathode elements to yield a plurality of insulator strips positioned at right angles to the cathode elements, forms the substrate for a plurality of independent, parallel column or grid conductor elements or "lines" running in the vertical direction. A glass cap member forms a fluid-tight seal with the viewing window along the cap's peripheral edge for containing the fluid suspension and also acts as a substrate for an anode plate deposited on the interior flat surface of the cap. When the cap is in place, the anode surface is in spaced parallel relation to both the cathode elements and the grid elements. Given a specific particulate suspension, the sign of the electrostatic charge which will attract and repel the pigment particles will be known. The cathode element voltage, the anode voltage, and the grid element voltage can then be ascertained such that when a particular voltage is applied to the cathode and another voltage is applied to the grid, the area proximate their intersection will assume a net charge sufficient to attract or repel pigment particles in suspension in the dielectric fluid. Since numerous cathode and grid lines are employed, there are numerous discrete intersection points which can be controlled by varying the voltage on the cathode and grid elements to cause localized visible regions of pigment concentration and rarefaction. Essentially then, the operating voltages on both cathode and grid must be able to assume at least two states corresponding to a logical one and a logical zero. Logical one for the cathode may either correspond to attraction or repulsion of pigment. Typically, the cathode and grid voltages are selected such that only when both are a logical one at a particular intersection point, will a sufficient electrostatic field be present at the intersection relative to the anode to cause the writing of a visual bit of information on the display through migration of pigment particles. The bit may be erased, e.g., upon a reversal of polarity and a logical zero-zero state occurring at the intersection coordinated with an erase voltage gradient between anode and cathode. In this manner, digitized data can be displayed on the electrophoretic display.

An alternative EPID construction is described in application Ser. No. 07/345,825 entitled DUAL ANODE FLAT PANEL DISPLAY APPARATUS and filed on May 1, 1989 for the assignee herein, which relates to an electrophoretic display in which the cathode/grid matrix as is found in triode-type displays is overlayed by a plurality of independent separately addressable "local" anode lines. The local anode lines are deposited upon and align with the grid lines and are insulated therefrom by interstitial lines of photoresist. The local anode lines are in addition to the "remote" anode, which is the layer deposited upon the anode faceplate or cap as in triode displays. The dual anode structure aforesaid provides enhanced operation by eliminating unwanted variations in display brightness between frames, increasing the speed of the display and decreasing the anode voltage required during Write and Hold cycles, all as explained in application Ser. No. 07/345,825.

A commonly sought objective for EPIDS of both triode and tetrode types, and for digital display equipment and computer and digital apparatus in general, is increased speed of operation. With respect to displays, it is desirable for the display to be able to write, erase and edit the displayed image as quickly as possible in response to operator input and computer processing. For example, when a computer with a visual output device for displaying character information, such as a CRT, is used as a word processor, if the writing and erasure of displayed information is not fast enough, it will slow the operator of the word processor in the completion of his task. Even though the computer memory and processing unit can operate at speeds far exceeding the capacity of a human user, if the input and output devices through which the computer communicates with the user are slow, the computer and the user must wait for the output devices. Thus, if a word processor user is paging through a document at high speed, a slow visual output device may well slow the speed of paging below that at which the user and/or the computer could potentially perform.

In EPIDS and in other display apparatus, because there are a plurality of pixels arranged on a coordinate grid or matrix, and because the pixels must be independently addressable, display operations are frequently conducted at the pixel level, e.g., each pixel is sequentially written to. Sequential operations are intrinsically time consuming, in that the prior operation must be completed before the subsequent can be started. Further, even though the writing of a single pixel can be done very quickly, there are such a large number that even a small write time is significant. A process for independently controlling individual pixel display whereby a degree of parallel display processing is accomplished is described, e.g., in U.S. Pat. No. 4,742,345, wherein display information pertaining to an entire line of pixels, i.e., On or Off, is accumulated in an accumulator or register during a first phase, placed in parallel into a latch array in a second phase and placed in parallel on one of the coordinate grids in a third phase. Placing the display information onto one of the coordinate line sets, e.g., the grid lines which may be oriented in the vertical direction, has been termed "loading" the data on the grid. When the bits of information (voltages corresponding to logical "1" and "0") are placed or "loaded" on, e.g., all the vertical coordinate lines, a single horizontal line can be written by enabling that line, i.e., by placing a voltage corresponding to a logical "1" on that horizontal line. The operation of placing an enabling voltage upon the line to be written, in this case a horizontal cathode line, has been referred to as "writing the line". Of course, this line-by-line writing method also has a upper limit of speed.

With respect to EPIDS, one factor which contributes to the speed with which the display can operate is the speed with which the pigment particles can travel through the electrophoretic fluid under the influence of a particular voltage gradient. Pigment particle migration speed depends, inter alia, upon particle size and electrophoretic fluid viscosity. In addition to the particle speed, there is also the factor of spatial distribution within the EPID envelope, i.e., because the particles are in suspension they are distributed, prior to being exposed to voltage gradients, relatively evenly within the fluid envelope. Accordingly, there is a range of particle proximity to the "target" element, the target element being that element to which the particles are sought to be directed to perform an operation, such as write or erase.

These speed and proximity factors in EPIDS are utilized in U.S. Pat. No. 4,833,464 to control pixel display intensity or grey scale. Namely, if a voltage gradient of shorter or longer duration is applied, fewer or greater particles will accumulate at the "target" electrode thereby affecting pixel intensity, i.e., the greater the number of particles, the greater the intensity. Note that pixel intensity is discernable at both sides of the typical EPID so that an intense accumulation of e.g., light colored particles, on one face of the EPID is accompanied by a correspondingly intense lack of light particles on the other face, which, in all probability, will appear dark due the selection of a dark solution or background for the light colored particles. Thus writing a character on one faceplate of an EPID results in its reverse image being written on the other plate. The writing of a blank character may be termed selective character erasure.

It is an objective of the present invention to provide a method for operating an EPID having any particular pigment particle size, electrophoretic fluid viscosity, electrode arrangement and operating voltage levels, such that the speed of operation is increased.

DISCLOSURE OF THE INVENTION

The problems and disadvantages associated with conventional methods of operating electrophoretic displays are overcome by the present inventive method for decreasing the time to write a frame of display data composed of a plurality of lines of displayable pixels on an electrophoretic display requiring a minimum time period for a line to be fully written. A set of at least two adjacent lines is written in a shortened period shorter in duration than the minimum period. The elements of the line set are then shifted such that the set contains at least one new line and at least one old line. The shifted line set is then written in a subsequent shortened period following the step of shifting. The set is repeatedly shifted and written in the foregoing fashion until the frame is completely written.

BRIEF DESCRIPTION OF THE DRAWINGS

For a better understanding of the present invention, reference is made to the following detailed description of an exemplary embodiment considered in conjunction with the accompanying drawings, in which.

BEST MODE FOR CARRYING OUT THE INVENTION

Figure 1:
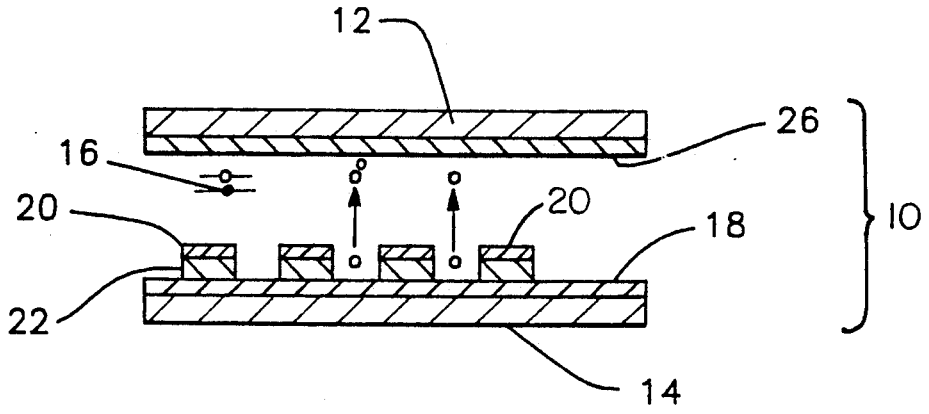
FIG. 1 PRIOR ART
FIG. 1 is a cross-sectional view of a typical triode-type EPID showing the essential electrical components thereof.

FIG. 1, which is taken from U.S. Pat. No. 4,732,830, shows an electrophoretic display 10 as is now known in the art. The display 10 has an anode faceplate 12 and a cathode faceplate 14 which are sealably affixed on either side of an interstitial spacer (not shown) to form a fluid-tight envelope for containing a dielectric/pigment particle suspension or electrophoretic fluid. The faceplates 12 and 14 are typically flat glass plates upon which are deposited conductor elements to comprise the situs of electrostatic charge for inducing motion of the pigment particles 16 in the electrophoretic fluid. The techniques, materials and dimensions used to form the conductor elements upon the faceplates and the methods for making and using EPIDS, in general, are shown in U.S. Pat. Nos. 4,655,897, 4,732,830 and 4,742,345 which patents are incorporated herein by reference.

Known EPIDS, as depicted in FIG. 1, for example, have a plurality of independent, electrically conductive cathode lines 18, shown here as horizontal rows, deposited upon the cathode faceplate 14 using conventional deposition and etching techniques. Of course, the orientation of the cathode lines 18 depends upon the orientation of the screen, which, if rotated 90 degrees, would position the cathode lines vertically. Thus, the cathode lines are arbitrarily defined as horizontal or in the x-axis. It is preferred that the cathode elements 18 be composed of Indium Tin Oxide (ITO) as set forth in U.S. Pat. No. 4,742,345. A plurality of independent grid conductor lines 20 are superposed in the vertical (parallel with the y-axis) over the cathode elements 18, i.e., at right angles thereto, and are insulated therefrom by an interstitial photoresist layer 22. The grid elements 20 may be formed by coating the photoresist layer 22 with a metal, such as nickel or chrome, using sputtering techniques or the like, and then selectively masking and etching to yield the intersecting but insulated configuration shown in FIG. 1. Each cathode and grid element 18, 20 terminates at one end in a contact pad, or is otherwise adapted to permit connection to display driver circuitry. An anode 26 is formed on an interior surface of the anode faceplate 12 by plating with a thin layer of conductor material, such as, chrome.

The foregoing components have been previously described in prior patents and applications of the present Applicants. In addition to these teachings, the benefits and operation of an EPID having a local anode have been recognized and described in application Ser. No. 07/345,825 by the present Applicants. The present inventive method could find application in any of these disclosed devices.

Figure 2:
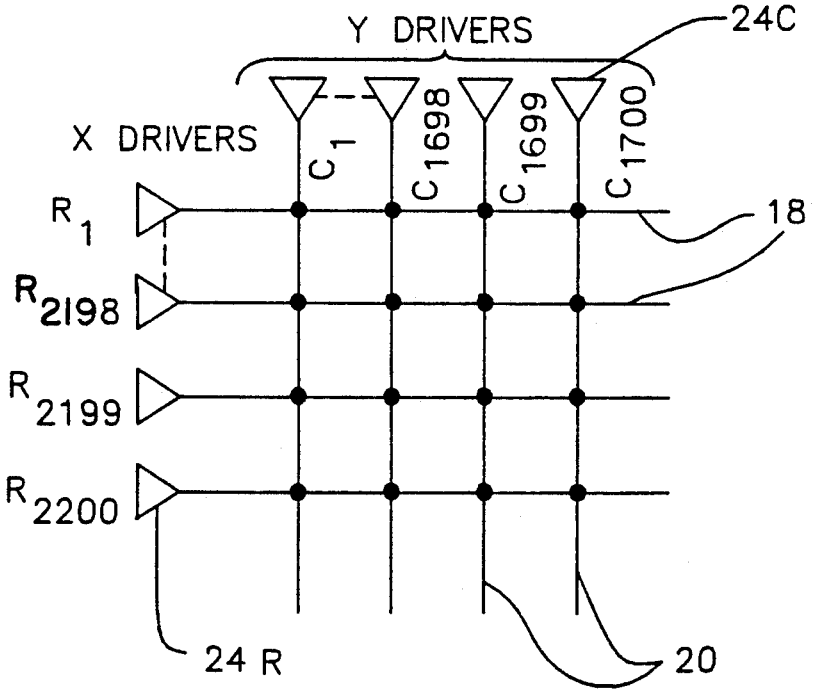
FIG. 2 PRIOR ART
FIG. 2 is a simplified schematic diagram illustrating an addressable display matrix comprised of horizontal and vertical elements, such as, a plurality of cathode lines and a plurality of grid lines, driven by display drivers, as would be used in known EPID devices like that shown in FIG. 1.

FIG. 2, also taken from U.S. Pat. No. 4,732,830, shows, in the simplest schematic form, how the cathode 18 and grid lines 20 comprise an addressable x-y matrix allowing pixels at the intersection points to be selectively displayed. Each horizontal 18 and vertical 20 line has an associated amplifier/driver 24R and 24C, respectively, for impressing either a logical "1" or "0" thereon, such that when both are "1" at an intersection, that intersection is written. The horizontal lines have been labelled R1 . . . R2200 to signify that 2200 display lines 18 or rows would typically be present. 1700 vertical lines 20 or columns are common, as depicted by the labels C1 . . . C1700.

Figure 3:
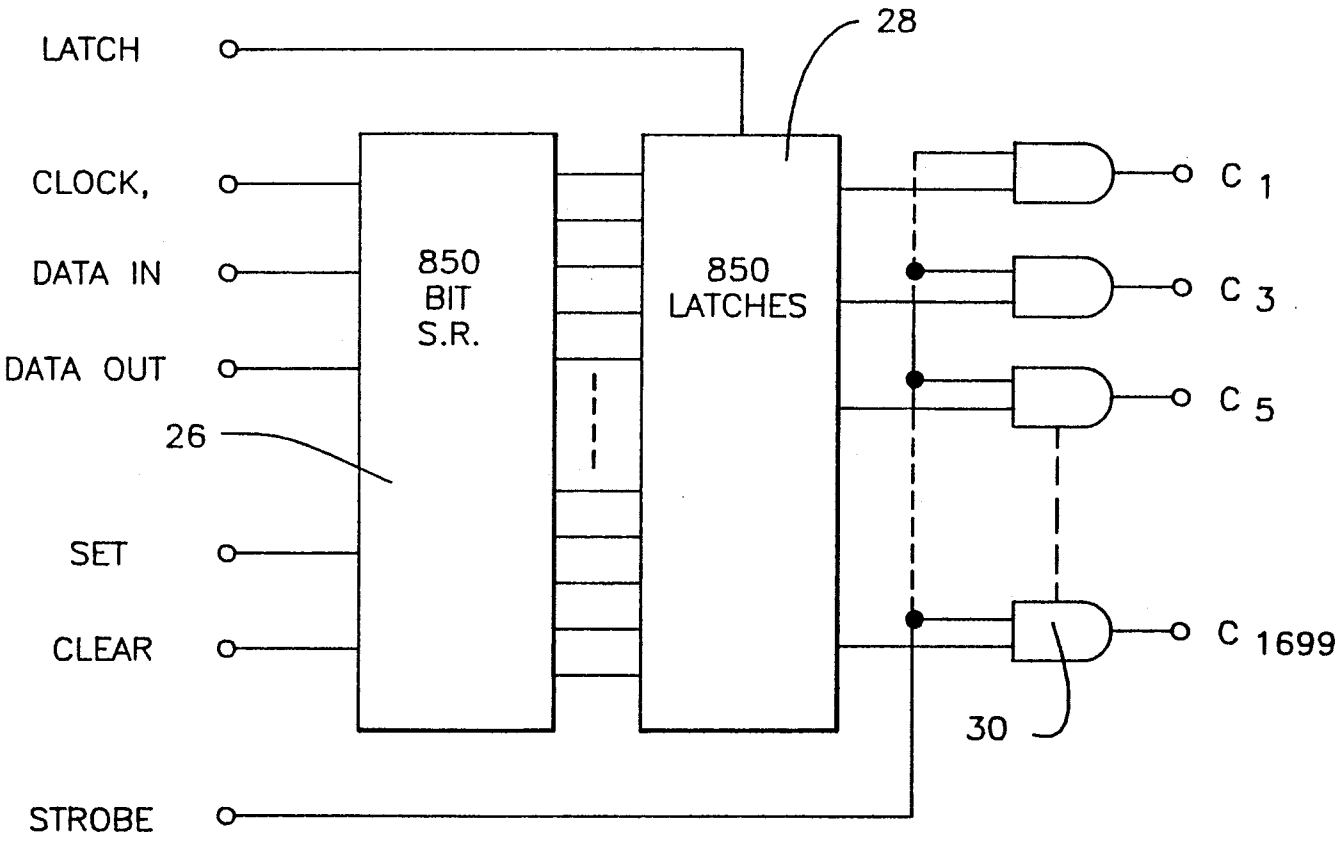
FIG. 3 PRIOR ART
FIG. 3 is a simplified schematic diagram illustrating circuitry for controlling the x and y display drivers illustrated in FIG. 2.

FIG. 3, taken from U.S. Pat. No. 4,742,345, shows exemplary circuitry for supplying input data to the x and y drivers, 24R and 24C. As explained fully in U.S. Pat. No. 4,742,345, which is incorporated herein by reference, a large capacity, composite, serial-to-parallel register 26 may be used as a buffer for collecting a large number of bits of display data, e.g., 850 bits. After sequentially clocking data into the register 26 and filling it to capacity, the data is latched in parallel into a latch array 28 having an equal capacity. The data is then strobed into the display driver amplifiers 24 through a plurality of AND gates 30. Data may be accumulated in the serial register while the transfer from latch array 28 to drivers 24 occurs. In FIG. 3 the output of the AND gates are labelled with odd number columns 1 through 1699. The data for even number columns would be supplied, in this case, by a twin circuit disposed on the cathode faceplate opposite to that for the odd columns. This configuration prevents overcrowding of electrical connections to the grid lines as explained in U.S. Pat. No. 4,742,345. Once the column data is supplied to all columns, a row can then be written by sending a "1" along the row or cathode 18 to be written. The row "1" in combination with any column "1" will cause the writing of a pixel at the intersection thereof, i.e., a voltage gradient at that point sufficient to cause a visually observable migration and agglomeration of pigment particles 16.

The proportions of the grid 20 and cathode 18 lines as shown in FIGS. 1 and 2 have been greatly enlarged for the purposes of illustration. In operational displays, the grid 20 and cathode 18 lines are very thin and elongated. A workable panel would have a large number of intersections, e.g., 2,200×1,700 or a total of 3,740,000 separately addressable intersection points in a panel approximately 8"×11". For ease of illustration, only a few cathode lines 18, and grid lines 20 are depicted. Additional illustrations of electrophoretic displays, their components and electrical circuitry can be seen by referring to U.S. Pat. Nos. 4,742,345 and 4,772,820, each being awarded to the inventors herein and which are incorporated by reference herein.

Figure 4:
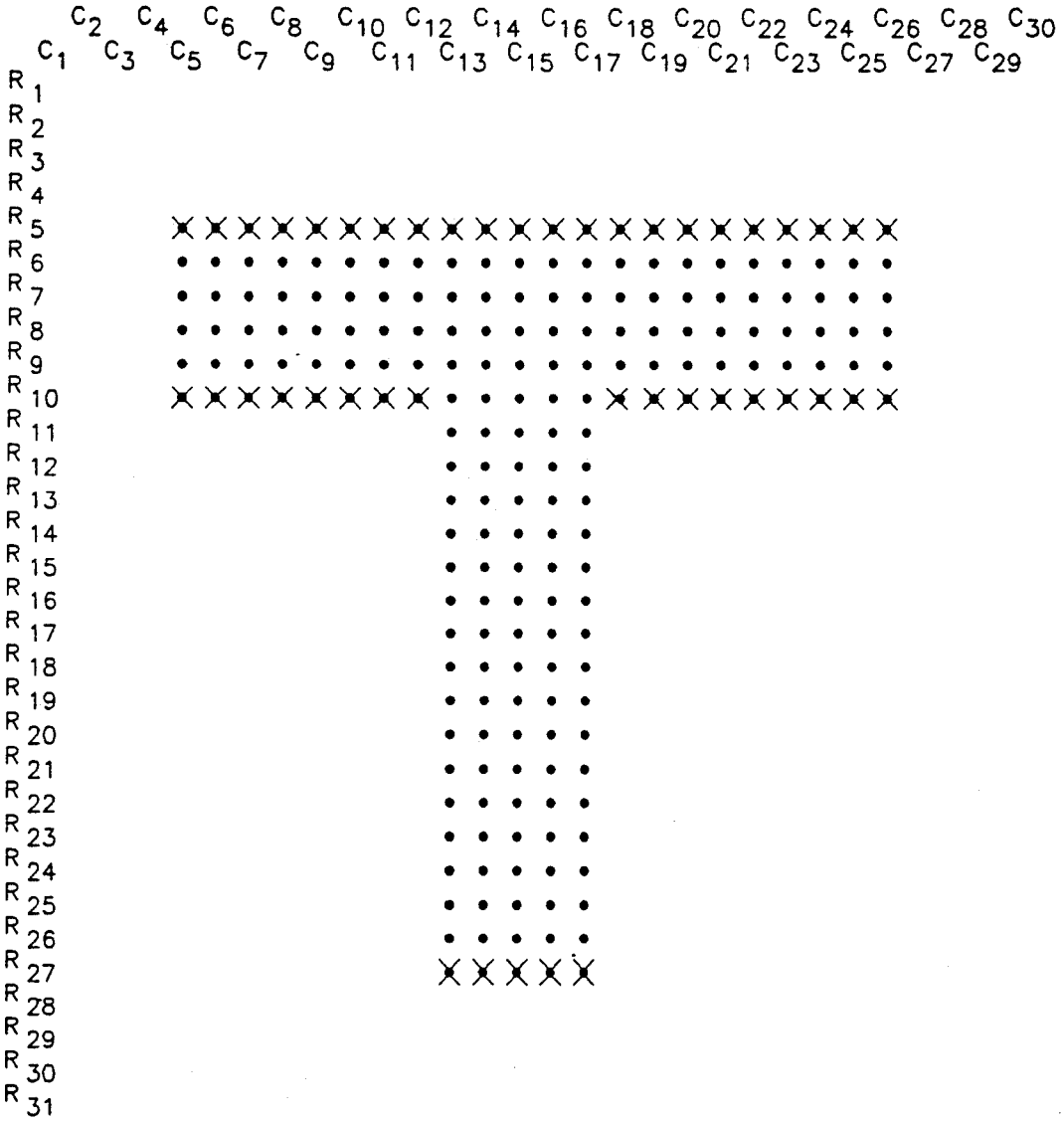
FIG. 4 shows a character which could be displayed upon an x-y matrix using the circuitry and apparatus as illustrated in FIGS. 1–3, as controlled and operated in accordance with the method of the present invention.
Figure 5:
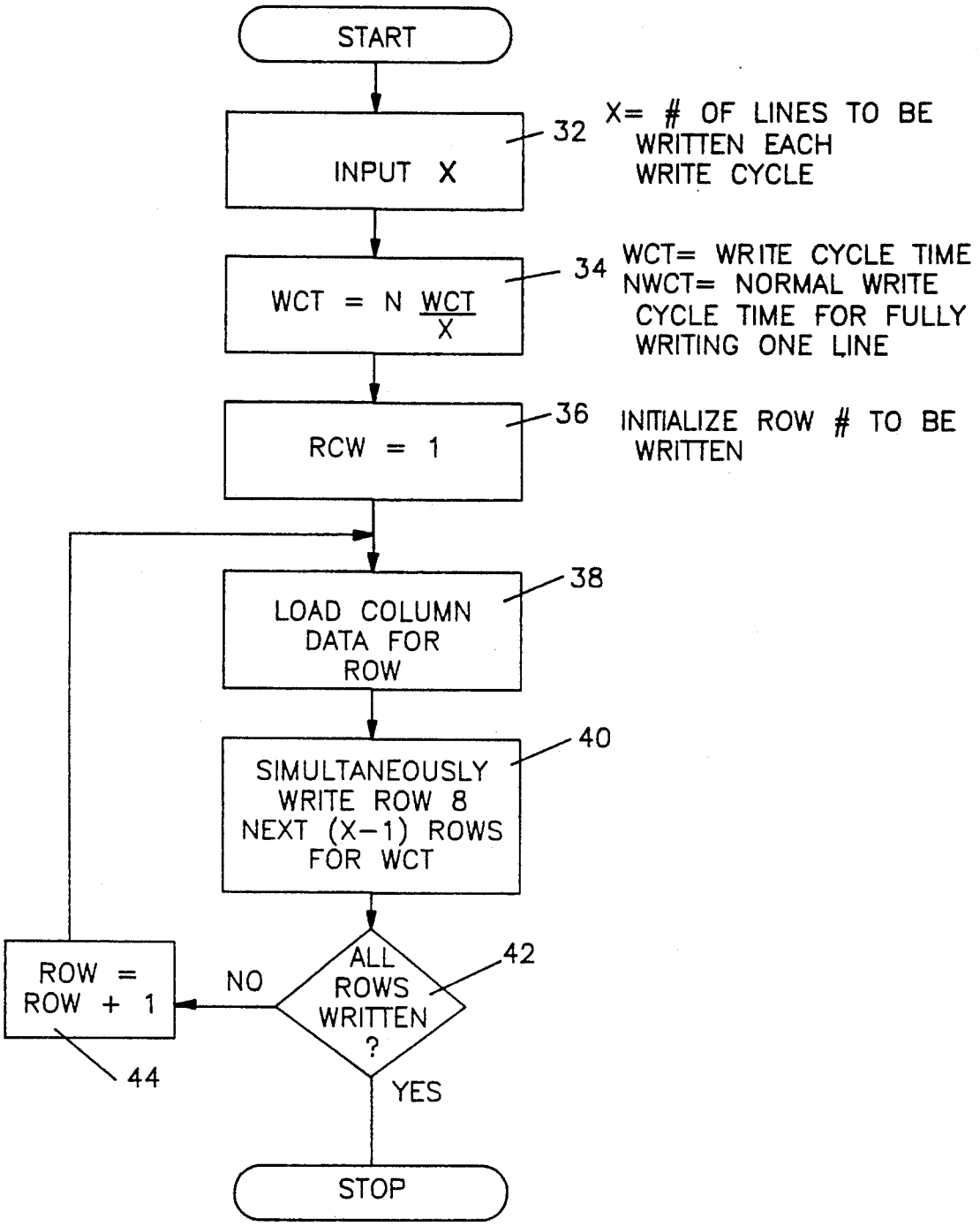
FIG. 5 is a flowchart showing a method for EPID writing in accordance with the present invention.

FIG. 4 illustrates a character, i.e., the letter "T" written on a EPID as described above in reference to FIGS. 1–3 by utilizing the algorithm flow-charted in FIG. 5. In accordance with the present inventive method, it has been observed that the writing time of the EPID can be reduced by simultaneously writing more than one line at a time. That is, in the above-described previously known EPIDS, an entire set of column data for a particular row is impressed upon the columns, e.g., the grid lines. A single row is then enabled with a logical "1" and thereby written. The next set of column data is loaded onto the grid lines and the next row is enabled or written. This goes on sequentially until the entire screen is written. There is a certain period required for the pigment particles to migrate through the electrophoretic fluid to their "write" position, i.e., to make an agglomeration sufficient in size to be clearly visible. Therefore each row in past operation had to be held in the logical "1" state for the required writing period or writing cycle time. In accordance with the present invention, if a set of rows greater than one row, e.g., two rows, is enabled simultaneously for a period approximately one-half as long in duration as was previously done, then the two rows will both be dimly written with the same display information in one half the cycle time. For instance, if column data for row 1 is loaded and rows 1 and 2 are written, both row 1 and row 2 will be dimly written with row 1 display information. If new column data, i.e., for row 2, is loaded and the row set is shifted down one and written, i.e., row set 2 and 3 are written using row 2 data, the first row which was half-written will be left untouched. The second row, however, will be fully written assuming the new column data associated with row 2 is the same as that associated with row 1. Row 3 is also dimly written with row 2 data. Thus, by partially writing subsequent overlapping row sets with shortened writing cycles, the entire display can be written much faster than if single rows are sequentially fully written. This row set writing strategy depends upon the fact that there is repetition in the pixel pattern from one row to the next. In fact, there is a high probability of that condition occurring. Because of high line density in the EPIDS in question, the number of lines comprising a single character is great. For example, a 70 line×25 line matrix with 1750 pixels may be used as the area for expressing a single character. As such, the pattern of pixels comprising the common characters is very repetitive. FIG. 4 illustrates this principle using a matrix of only 22×22 lines, i.e., those lines centrally located within the entire 29×31 line matrix depicted. The top of the "T" begins at (r5,c5) and ends at (r9,c26). The significance of the X's on row 5 will be explained below. The stem of the "T" starts at (r10,c13) and ends at (r26,c17). As can readily be seen, the top of the "T" is composed of 5 identical rows of pixels and the stem of the "T" is composed of 17 identical rows of pixels. It will, of course, be apparent that within each group of identical rows of pixels making up the illustrative "T" character, each row starts the same distance away from a common reference line, such as the edge of the display. The "T" depicted in FIG. 4 is an example of applying the present inventive method in writing in two row sets at one half the normal write cycle time (twice the writing speed). Specifically, one would execute the following steps in order to display the "T" shown in FIG. 4.:

| Load | c1-c29 | with | data | for | r1 |
|---|---|---|---|---|---|

(0,0,0,0,0,0,0,0 . . . 0)
Write r1 and r2 simultaneously (put "1" on r1 and r2)
Load c1-c29 (the grid lines) with data for r2
(0,0,0,0, . . . 0)
Write r2,r3
Load grid with r3 data
Write r3, r4
Load grid with r4 data
Write r4,r5

Note: for the purposes of this example, r5 has been selected as the first line that has "1s" or written pixels in it and it should be the first line of the "top" of the "T". Due to the fact, however, that r5 is a transition line, i.e., a transition from non-written to written pixels, it will not be completely written and instead will only be dimly written or half written. This is so because each write cycle, since it is at twice the speed as a normal cycle, only "half writes" the information. The next cycle is necessary to fully write the information, but only if the next cycle uses the same data. In the case of a transition line, succeeding rows have different data. Since there are so many lines of pixels in operable displays, the loss of small numbers of transition lines and/or pixels does not cause a significant loss in readability. Returning now to the writing process:

| Load | grid | with | r5 | data |
|---|---|---|---|---|

(0,0,0,0,1,1,1,1,1,1,1,1 . . . 1,0,0,0)
Write r5,r6
Load grid with r6 data (same as r5 data)
Write r6, r7 (since r6 was previously "half" written with r5 data in the prior cycle and since the r5 data was the same as the r6 data, r6 is written completely on the subsequent cycle.)
Load r7 data
Write r7,r8
Load r8
Write r8,r9
Load r9
Write r9,r10 (r10 is another partial transition line, i.e., it is the transition from the top of the "T" to the stem of the "T". Since the r9 data is written on line 10, a portion thereof, i.e., that which should contain non-written pixels—the X's—will be dimly or half written.)
Load r10
Write r10,r11
repeats until row 26 where:
Load r26
Write r26,r27 (constitutes another transition line)
Load r27
Write r27, r28, etc.

The foregoing should illustrate one embodiment of the present inventive method. Further, it can be understood that in lieu of two line set writing, three, four, or more lines can be written simultaneously with corresponding increases in speed and in transition lines which will be of varying intensity depending upon the number of repetitions of writes to those transition lines. For example, in four line set writing, when a transition from blank to written pixels occurs, there are three transition lines, the first being the dimmest and the last, the darkest. The fourth line written will be fully written. Similarly, in a transition from written to non-written pixels, there will be three transition lines, the first being the darkest and the last the dimmest. The fourth line will be non-written. Of course, in four line set writing, the benefit of increasing writing speed over the normal speed would be utilized to produce a fourfold increase in speed.

FIG. 5 is a generalized flowchart of the steps of the present inventive method for operating an EPID in a multi-line write mode. It would be expected that operator selection of display writing speed would be offered so that the operator can choose the speed and clarity. This sort of selection is presently offered to operators upon printing on dot-matrix printers, i.e., enhanced printing has greater pixel density but takes longer to print. Accordingly, the operator first enters the number of lines to be written in each write cycle 32. From this input the write cycle time (writing speed) is adjusted 34. The greater the number of lines simultaneously written in each write cycle, the faster the writing speed. Of course, the operator input could be expressed as a selection of writing speed, wherein the operator would select from a range of speeds corresponding to the number of lines simultaneously written. The flowchart shown in FIG. 5 pertains to the display of a single complete image (frame) on the EPID. This algorithm would be utilized over and over under the control of programming at the next higher level. The operator would not be queried as to the operating speed on each frame displayed. Information of that type would be initially set by query or default then changed by interrupt if desired. Having determined the line set size for writing, the writing is begun at the first row 36. (Of course, it would be equally feasible to load rows with data and write columns.) The processor then enters a loop wherein data for the current row is loaded onto the column lines (here grid lines) 38. The data is simultaneously written on the current row and the next $x-1$ rows by enabling those rows with a logical "1" 40, x being the number of rows in the write set selected. Thus, on the first write cycle in a 4 line set write mode, row 1 and the next $(4-1)$ or 3 rows, i.e., rows 2, 3 and 4 are written. Note that the "1" state may correspond to a variety of voltages depending upon the EPID in question, e.g., whether the EPID is a triode or tetrode. A voltage of 0 volts has been used to enable writing in triodes and, in those instances represents a logical "1" or enable state. The row set is written for a write cycle time that has been adjusted by the size of the row set (divided by). This is continued until all rows are written 42,44, whereupon control is returned to the next higher level in the program. Of course other line writing sequences could be employed using a multi-line write strategy, for example, vertical lines can be written from left to right or right to left, horizontal lines could be written from bottom to top or from the middle to the outer periphery, etc.

It should be understood that the embodiments described herein are merely exemplary and that a person skilled in the art may make many variations and modifications without departing from the spirit and scope of the invention as defined in the appended claims.

We claim:

1. A method for decreasing the time to write a frame of display data composed of a plurality of lines of displayable pixels on an electrophoretic display requiring a minimum time period for a line to be fully written comprising the following steps:

(a) selecting a shortened period which is shorter in duration than said minimum period;

(b) writing a line set of at least two adjacent lines in said shortened period;

(c) shifting the lines of said line set such that said line set contains at least one new line and at least one old line;

(d) writing said shifted line set in a subsequent shortened period following said step of shifting; and (e) repeating steps (c) and (d) until said frame is completely written.

2. The method of claim 1, wherein said shortened period is shorter when the number of lines in said line set is greater.

3. The method of claim 2, wherein said shortened period approximates said minimum period divided by the number of lines in said line set.

4. The method of claim 1, wherein said pixels of said old line are written darker when said new line contains pixels of an equal displacement from a common reference line.

5. The method of claim 4, wherein said darker written pixels are written with an intensity approximating the intensity of a pixel written for said minimum period.

6. The method of claim 5, further including the step of selecting the number of lines in said line set.

7. The method of claim 6, further including the step of adjusting said shortened period when a change in the number of lines in said line set occurs.

8. The method of claim 5, wherein said reference line is located on an edge of said display.

9. A method for operating an electrophoretic display of the type having a first plurality of parallel conductive lines disposed within a first plane and a second plurality of parallel conductive lines disposed within a second plane insulated from said first plurality, said first and said second plane being substantially parallel and said first and said second plurality being substantially perpendicular to form an X-Y addressing matrix, said display having a conventional anode electrode separated from said X-Y matrix with the space therebetween accommodating an electrophoretic dispersion including pigment particles suspended in a fluid, each of said first and said second plurality being selectively electrically chargeable to create a voltage gradient at each of said intersections of said X-Y matrix in conjunction with said anode to cause a localized migration of pigment particles relative to said intersections, said intersections constituting displayable pixels, comprises the following steps in substantially the following order:

(a) selectively electrically charging each of said first plurality of lines with a first set of voltage levels;

(b) while said first plurality remains electrically charged, simultaneously electrically charging a set of 2 or more adjacent lines of said second plurality of lines for a selected period such that said pigment particles are caused either to migrate or not to migrate proximate said intersections associated with said 2 or more adjacent lines depending upon said voltage levels applied to each said line of said first plurality of lines;

(c) shifting the elements of said set by one adjacent line, such that the same number of elements are present in said set but the content of said set excludes at least one previously included element and includes at least one common element which was previously included in said set prior to shifting and one new element which is a line adjacent to said at least one common element;

(d) selectively electrically charging each of said first plurality of lines with a second set of voltage levels; and (e) repeating steps (b) through (d) substituting subsequent sets of voltage levels in step (d) until all said pixels at said intersections of said X-Y matrix have been placed in a selected display state.

10. The method of claim 9, wherein said selected period is less than a normal writing period for fully writing a line of said pixels.

11. The method of claim 10, wherein said selected period becomes less when said set of 2 or more adjacent lines has more members.

12. The method of claim 11, wherein said selected period approximates the period associated with a normal write cycle period divided by the number of lines in said set of adjacent lines.

13. The method of claim 12, further including the step of selecting the number of lines in said set of adjacent lines.

14. The method of claim 13, further including the step of adjusting said selected period when a change in the number of lines in said set of adjacent lines occurs during said step of selecting the number of lines.

15. The method of claim 14, wherein said first plurality of lines are the grid lines of a triode-type EPID display.

16. The method of claim 15, wherein said second plurality of lines are the cathode lines of a triode-type EPID.

17. The method of claim 9, wherein said step of selectively electrically charging each of said first plurality of lines of step (a) is the loading of display data expressed as said set of voltage levels onto said grid lines.

18. The method of claim 9, wherein said step of simultaneously electrically charging a set of 2 or more adjacent lines is impressing a write enabling voltage on said adjacent lines, said write enabling voltage having a logical value of "1" and an operational value of "ON".

19. The method of claim 18, wherein said voltage levels in said voltage level set may assume either of at least two voltages, a first voltage having a logical value of "1" and an operational value of "ON" or a second voltage having a logical value of "0" and an operational value of "OFF".

20. The method of claim 19, wherein said pigment particles migrate in a direction leading to the display of a pixel located at said intersections where a line of said first plurality of lines and a line of said second plurality of lines both have a logical value of "1" simultaneously.

21. The method of claim 20, wherein said set of 2 or more lines contains 2 lines.

22. The method of claim 21, wherein said set of 2 lines is cathode line 1 and cathode line 2 starting at the top of said display during the first performance of steps b through d, cathode line 2 and cathode line 3 during the first repetition of steps (b) through (d), and cathode line 3 and cathode line 4 during the second repetition.

23. The method of claim 20, wherein said set of 2 or more lines contains 3 lines.

24. The method of claim 23, wherein said set of 3 lines is cathode lines 1, 2 and 3 starting at the top of said display during the first performance of steps b through d, cathode lines 2, 3 and 4 during the first repetition of steps (b) through (d), and cathode lines 3, 4 and 5 during the second repetition.

25. The method of claim 20, wherein said set of 2 or more lines contains 4 lines.

26. The method of claim 25, wherein said set of 4 lines is cathode lines 1, 2, 3 and 4 starting at the top of said display during the first performance of steps b through d, cathode lines 2, 3, 4 and 5 during the first repetition of steps (b) through (d), and cathode lines 3, 4, 5 and 6 during the second repetition.

* * * * *